US008522479B2

(12) United States Patent
Massey et al.

(10) Patent No.: US 8,522,479 B2
(45) Date of Patent: Sep. 3, 2013

(54) DOOR ASSEMBLY INCLUDING ASTRAGAL

(75) Inventors: Victor T. Massey, Winston-Salem, NC (US); Kevin Hall, Charlotte, NC (US)

(73) Assignee: Masonite International Corporation, Mississuaga, Ontario (CA)

( * ) Notice: Subject to any disclaimer, the term of this patent is extended or adjusted under 35 U.S.C. 154(b) by 0 days.

(21) Appl. No.: 13/048,295

(22) Filed: Mar. 15, 2011

(65) Prior Publication Data

US 2011/0162281 A1 Jul. 7, 2011

Related U.S. Application Data

(62) Division of application No. 10/673,643, filed on Sep. 30, 2003, now Pat. No. 7,905,058.

(60) Provisional application No. 60/414,654, filed on Oct. 1, 2002.

(51) Int. Cl.
*E06B 5/00* (2006.01)

(52) U.S. Cl.
USPC ..... 49/365; 49/366; 49/504; 52/204.1

(58) Field of Classification Search
USPC ..... 49/365, 366, 367, 368, 369, 462, 49/504, 460, DIG. 1; 52/204.51, 207, 210, 52/211, 717.01, 204.1
See application file for complete search history.

(56) References Cited

U.S. PATENT DOCUMENTS 3,364,624 A * 1/1968 Davis ..... 49/505
3,491,584 A * 1/1970 Selzer ..... 49/501
4,009,537 A * 3/1977 Hubbard ..... 49/319
4,052,819 A * 10/1977 Beischel et al. ..... 49/368
4,058,332 A * 11/1977 DiFazio ..... 292/147
4,242,648 A * 12/1980 Liu et al. ..... 372/61
4,281,480 A * 8/1981 Wendt ..... 49/504
4,429,493 A * 2/1984 St. Aubin ..... 49/367
RE31,536 E * 3/1984 Holdiman et al. ..... 49/501
4,573,287 A * 3/1986 Hagemeyer et al. ..... 49/381
4,594,812 A * 6/1986 Clancy et al. ..... 49/404
4,644,696 A * 2/1987 Bursk ..... 49/367
5,328,217 A * 7/1994 Sanders ..... 292/341.19
5,335,450 A * 8/1994 Procton ..... 49/368
5,350,207 A * 9/1994 Sanders ..... 292/335
5,355,450 A * 10/1994 Garmon et al. ..... 345/501
5,590,919 A * 1/1997 Germano ..... 292/137
5,675,947 A * 10/1997 Yane ..... 52/207
5,758,458 A * 6/1998 Ridge ..... 52/204.1
5,836,628 A * 11/1998 Beier ..... 292/346
5,857,291 A * 1/1999 Headrick ..... 49/368
6,082,049 A * 7/2000 Hudson ..... 49/460
6,192,638 B1 * 2/2001 Wang ..... 52/213
6,393,780 B1 * 5/2002 Jung ..... 52/211
6,453,616 B1 * 9/2002 Wright ..... 49/365
6,457,751 B1 * 10/2002 Hartman ..... 292/137
6,491,326 B1 * 12/2002 Massey et al. ..... 292/162
6,651,390 B2 * 11/2003 Camperelli ..... 49/504
6,684,571 B2 * 2/2004 Hendrickson et al. ..... 49/428
6,740,187 B2 * 5/2004 Schweikart ..... 156/250
2003/0052492 A1 * 3/2003 Massey et al. ..... 292/341.15

* cited by examiner

*Primary Examiner* — Gregory J. Strimbu
(74) *Attorney, Agent, or Firm* — Berenato & White, LLC

(57) ABSTRACT

A double door assembly having an active door and a passive door includes an astragal that is formed of a composite of aluminum and wood. The astragal is formed of an aluminum rail with a U-shaped cross section that receives a wooden insert. The astragal is mounted to a passive door such that the U-shaped cross section opens to the active door and the wooden insert presents a mounting surface for hardware.

8 Claims, 2 Drawing Sheets

DOOR ASSEMBLY INCLUDING ASTRAGAL

CROSS REFERENCE TO RELATED APPLICATIONS

This application is a divisional of U.S. application Ser. No. 10/673,643, filed on Sep. 30, 2003, now U.S. Pat. No. 7,905,058, which relates to and claims priority to U.S. Provisional Patent Application No. 60/414,654, entitled "Astragal Assembly For Use On Exterior Doors," filed on Oct. 1, 2002, the disclosures of which are incorporated herein by reference.

BACKGROUND OF THE INVENTION

1. Field of the Invention

This invention relates to exterior double door systems for use on buildings. In particular, this invention relates to an astragal for use in such a double door system.

2. Description of Related Art

Double door systems used in buildings as exterior doors typically include a passive door and an active door. The passive door remains fixed in place while the active door is mounted for pivotal movement. The passive door can be fixed permanently in place or releasably secured in place so that it may be opened after the active door is opened. In any case, the passive door is fixed prior to closing the active door.

In these double door systems, molding commonly called an astragal is mounted on the passive door. The astragal fills in the gap between the passive door and the active door and forms an integral part of the door system. The astragal serves two main functions: to secure the passive door in place and to provide a positive stop with a weather strip for the active door. Another common function of the astragal is to provide a surface to receive door hardware, such as a strike plate.

The building industry offers many types of astragal designs. One type is all wood, another type is all aluminum, and a third type is a combination of aluminum and wood.

The all wood design is low cost and easily installed. The wood surface also allows an installer a great deal of flexibility to accept various types of door hardware. However, wood is a weak building material compared to metal and requires a great deal of maintenance to protect it from decay.

All aluminum astragals are strong and lightweight and provide a maintenance free exterior. These astragals are easily able to withstand the stresses of normal use of an exterior door. However, aluminum is significantly more expensive than wood and does not provide any insulation, which is critical in exterior installations. Additionally, aluminum moldings typically have preset fastening formations, such as predrilled holes, so that a limited number of hardware options are available to an installer. Further, use of a dead bolt requires boring into the passive door as the aluminum astragal does not have the depth to accept the full throw of a dead bolt latch.

In an effort to use the advantages of each of these known designs, the building industry has combined aluminum and wood astragals. Typically, a wooden body is clad with an aluminum cover. The combination design lowers the cost, as less aluminum is required, and offers flexibility to accept alternate door hardware to attach to the wooden body. The drawback of this design is poor performance and durability. The wooden body is weakened when machined to receive the attachment fastener, typically a bolt or screw. The remaining wood piece offers minimal structural support and easily breaks under the stresses of normal use.

There is a need to provide a strong, durable astragal that is usable in a variety of installations and offers flexibility with respect to hardware installation.

SUMMARY OF THE INVENTION

One aspect of embodiments of this invention provides an astragal formed of a combination of metallic material that offers strength and wood that offers hardware installation flexibility.

Another aspect of embodiments of this invention provides an astragal that is suitable for use in a variety of installations without requiring a custom design.

A further aspect of embodiments of this invention provides an astragal that uses universal components that can reduce inventory requirements.

An additional aspect of embodiments of this invention provides an astragal design that can fully accommodate a locking mechanism.

The invention is directed to an astragal assembly for attachment to a passive door comprising a metallic rail having an exterior portion, an interior portion spaced from and opposed to the exterior portion, and a side portion extending between the exterior portion and the interior portion. An elongated open channel is defined in the metallic rail with sides formed by the exterior portion and the interior portion and a base formed by the side portion. A wooden insert is retained within the elongated open channel in the metallic rail.

In particular, an aspect of embodiments of the invention relates to an astragal comprising an extruded aluminum rail with an exterior portion having an exterior flange extending from one side and a stop extending from an opposed side, an interior portion spaced from and opposed to the exterior portion, and a side portion extending between the exterior portion and the interior portion having a fastening formation. A wooden insert is retained within a channel in the extruded aluminum rail formed by the exterior portion, the interior portion and the side portion. The wooden insert presents an outer surface for attachment to hardware.

The invention is also directed to a door assembly comprising a passive door having an outer edge and an active door having an outer edge. The active door is mounted for movement between an open position and a closed position in which the outer edge is aligned with the outer edge of the passive door. An astragal is coupled to the outer edge of the passive door. The astragal includes a metallic rail having an exterior portion, an interior portion spaced from and opposed to the exterior portion, and a side portion that extends between the exterior portion and the interior portion and abuts the outer edge of the passive door. An elongated open channel is defined in the metallic rail with sides formed by the exterior portion and the interior portion and a base formed by the side portion. A wooden insert is retained within the elongated open channel in the metallic rail that faces the active door in the closed position.

These and other aspects of this invention will become apparent upon reading the following disclosure in accordance with the Figures.

BRIEF DESCRIPTION OF THE DRAWINGS

An understanding of the various embodiments of the invention may be gained by virtue of the following figures, of which like elements in various figures will have common reference numbers, and wherein.

DETAILED DESCRIPTION OF PREFERRED EMBODIMENTS

The invention is described with reference to an exterior double door assembly for use on a building for purposes of illustration. It is to be understood that various concepts and components of this invention can be implemented on any type of closure, including interior and exterior closures, and closures used in different applications other than buildings.

Figure 1:
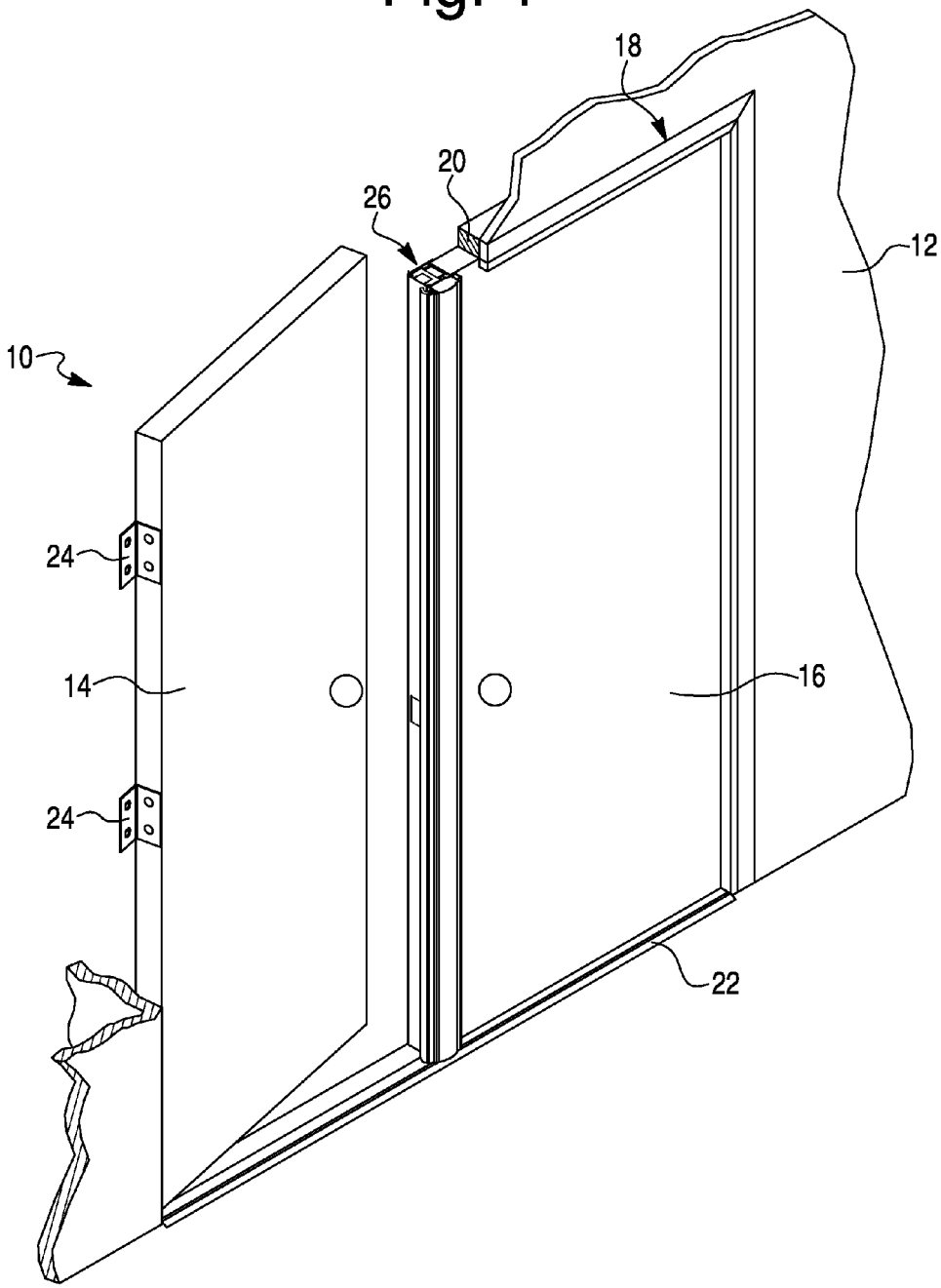
FIG. 1 is a perspective view partially broken away of a door assembly having an astragal in accordance with the invention.

FIG. 1 shows an exterior double door assembly in accordance with an embodiment of this invention. Although two doors are shown, any configuration of doors and windows could be used including different combinations of fixed and movable doors and side lights. Further, the door design shown generically in FIG. 1 can encompass any known type of door design and hanging configuration.

For purposes of explanation, the terms exterior and interior are used in the following description. Conventionally, the exterior refers to the exterior portion of the building, and the interior refers to the interior portion of the building. However, these terms are intended to generically refer to the opposed sides of the door assembly, with the interior portion being the area that the active door opens toward. Thus, these terms are intended to cover all interior applications as well as an exterior application.

As seen in FIG. 1, a door assembly 10 is mounted in a wall, such as an exterior wall 12 of a building. The door assembly includes an active door 14 and a passive door 16. As is known, the active door 14 and the passive door 16 are mounted in a frame 18 including a transom 20. A sill 22 is positioned at the base of the frame 18 and provides a transition between the exterior and interior of the building, in this case. This invention is designed to fit within a universal frame, particularly a universal transom and sill. Thus, ideally no custom adaptations are necessary for use. Of course, if it is desired to provide custom options that would be possible.

Any known type of door may be used as the active door 14 and the passive door 16, including but not limited to wooden doors, metal doors, and solid or glazed doors. Such doors suitable for use in this design are typically called French doors or patio doors.

The active door 14 is mounted for pivotal movement by hinges 24 to allow the active door 14 to swing between a closed position and an open position. The open position is shown in FIGS. 1 and 2.

The passive door 16 is fixed in place to act as a stop for the active door 14. The passive door 16 may be permanently mounted to the frame or may be mounted for pivotal movement. In the latter case, the passive door 16 can be unfastened and opened when the active door 14 is in the open position.

An astragal assembly 26 is mounted on the passive door 16, as will be described below. The astragal assembly 26 is also preferably mounted to the frame 18 and the sill 22. The astragal assembly 26 may be permanently mounted to the transom 20 and the sill 22 if the passive door 16 is the fixed type or releasably mounted to the transom 20 and/or the sill 22 by a movable fastener, such as a sliding bolt, if the passive door 16 is the movable type. Fastening the astragal assembly 26 to the structure provides a secure and stable door assembly 10. Any known type of fastening arrangement may be used. It is also possible to fix the astragal assembly 26 to only the transom 20 and the sill 22, in which case the step of attaching the astragal assembly 26 to the passive door 16 can be omitted.

Figure 2:
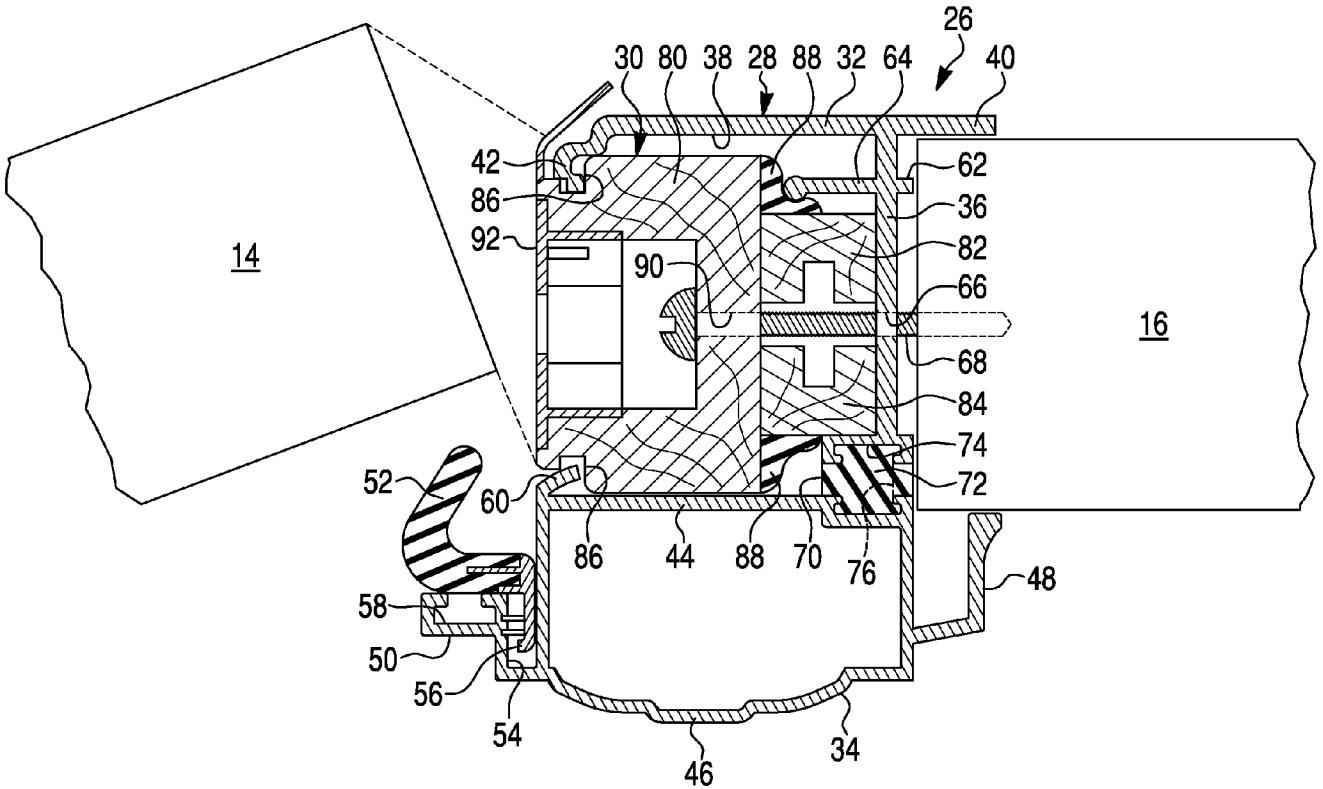
FIG. 2 is an enlarged partial top view of the door assembly with the astragal in cross section.

Referring to FIG. 2, the astragal assembly 26 is shown in detail. The astragal assembly 26 is formed as a composite including a frame 28 and an insert 30. The frame 28 is formed of a strong, lightweight material, such as a metallic material, preferably extruded aluminum. Of course, any suitable material used in building that is strong and lightweight could be used, even plastics. The frame 28 in the preferred embodiment is an extruded aluminum rail that is easily manufactured in various shapes.

The insert 30 is formed of any inexpensive material for which minimal skill and effort is required for attachment of hardware. In the preferred embodiment, the insert 30 is made of wood. As will be explained below, the insert 30 may be made of a single strip or plural strips used together. Preferably, the insert 30 is designed to be symmetrical about at least one axis to reduce manufacturing costs and inventory requirements. The number, size, and composition of the strips may vary based on cost, manufacturing, and inventory considerations. Any known building material, including different types of wood and wood/plastic composites or even all plastic materials could be used if desired and remain within the scope of the invention.

The frame or rail 28 is formed with an interior portion 32, and exterior portion 34 and a side portion 36 that define an internal channel 38 that opens outwardly. Preferably, the rail 28 is extruded as one piece.

The interior portion 32 is designed to face inwardly with respect to direction that the active door 14 opens. The interior portion 32 is formed of a single wall with an interior flange 40 at one end and a hook 42 at the other end. The interior flange 40 overlaps with an outer edge of the passive door 16. The hook 42 curves inward toward the channel 38 and holds the insert 30 in place.

The exterior portion 34 is formed as a hollow elongate tubular section having an inner wall 44 and an outer wall 46. The hollow shape allows a decorative face to be formed in the outer wall 46, adds a thermal barrier between the inner wall 44 and the outer wall 46, and adds thickness to the exterior portion 34 to facilitate the stopping function of the astragal assembly 26. An exterior flange 48 is provided on one edge of the exterior portion 34 and overlaps an exterior surface of the passive door 16. The exterior flange 48 is oriented at an angle to the interior flange 40 to facilitate attachment to the edge of the passive door 16. By this arrangement, the outer edge of the passive door 16 is clamped between the interior flange 40 and the exterior flange 48.

The other edge of the exterior portion 34 has a stop formation 50. The stop formation 50 extends outwardly toward the active door 14 and limits the outer swing of the active door 14. A gasket 52 is retained by the stop formation 50. The gasket 52 cushions the active door 14 from the stop formation 50 and acts as a weather strip. The stop formation 50, in the preferred embodiment shown, has a gap 54 that retains a clip 56 to which the gasket 52 is secured. Alternatively, the stop formation 50 can include a groove 58 that holds an edge of a gasket 52. Any type of known gasket or weather strip can be used.

The inner wall 44 of the exterior portion 34 has a hook 60 on its outer end that protrudes into the channel 38 to retain the insert 30, similar to the hook 42.

The side portion 36 connects the interior portion 32 to the exterior portion 34 and extends between the inner wall 44 adjacent to the exterior flange 48 and the interior portion 32 adjacent to the interior flange 40. The side portion 36 is formed as a thin wall designed to extend parallel to the outer edge of the passive door 16.

An outer spacer 62 may be provided that extends a small distance outward from the side portion 36 to form a small gap between the outer edge of the passive door 16. Any number and size of outer spacers 62 may be used, if desired, to allow air flow and prevent moisture from accumulating between the passive door 16 and the astragal assembly 26. An inner spacer 64 that extends from the side portion 36 into the channel 38 can be provided to assist in positioning the insert 30 and/or for stiffening. Any number or configuration of inner spacers 64 can be used.

Preferably, a series of preformed fastener holes 66 are provided in the side portion 36 to permit the insertion of a fastener 68, such as a screw, through the rail 28 into the passive door 16.

A thermal break 70 is designed within the side portion 36 to form a thermal barrier between the external portion 34 and the internal portion 32. The thermal break 70 is preferably formed as an elastomeric gasket 72 retained within a groove 74 formed in the side portion 36. The groove 74 can be formed with a frangible wall 76 that can be removed at installation. Of course, any suitable thermal break can be used to inhibit the transfer of heat between the exterior portion 34 and the interior portion 32. The wall of the groove 74 also acts as an inner spacer to assist in positioning the insert 30.

The insert 30 is designed to be retained with the channel 38 of the rail 28. Preferably, the insert 30 is formed symmetrically so that it is reversible and simply installed. As described above, the insert 30 is preferably wooden, but can be any inexpensive easily fastened material. The insert 30 can be formed as one piece, by a lathe for example, or as several simply shaped pieces to reduce the cost of manufacture. In the embodiment shown, the insert 30 includes a main strip 80 and a pair of secondary strips 82 and 84. Each strip 80, 82 and 84 are formed with a central open groove to reduce weight. However, solid strips may be used and may even be preferred for strength purposes.

The main strip 80 has a width slightly smaller than the width of the channel 38 and is formed with corner cutouts 86 that interlock with the hooks 42 and 60. The secondary strips 82 and 84 together have a width slightly smaller than a width between the inner spacer 64 and the wall of the groove 74. A cushion 88 can be provided on the shoulder between the main strip 80 and the secondary strips 82 and 84 to form a snug fit between the insert 30 and the inner spacer 64. This configuration allows the insert 30 to fit snugly within the rail 28 and be retained within the channel 38.

Fastener openings 90 are provided in the insert 30 and may be preformed or drilled in place. The openings 90 are preferably preformed to ensure alignment between the openings 90 in the insert 30 and the holes 66 in the rail 28. Fasteners 68 are secured within the openings 90 and holes 66 to hold the astragal assembly 26 in place on the passive door 16. It is also possible to eliminate the use of a fastener 68 if other attachment mechanisms are used, such as an alternative clamping flange or a spline formed in the side portion 36 of the rail 28 that directly engages the passive door 16.

Hardware is secured to the outer surface of the insert 30, which in this case provides a wooden face that is easily drilled or screwed. FIG. 2 shows a strike plate 92 attached in a groove in the insert 30. The groove is also sized to accommodate the full throw of a dead bolt if desired.

Since the astragal assembly 26 is easily attached to a variety of doors, it is contemplated that the astragal assembly 26 of this invention is usable in a universal modular system in which various components can be interchanged within a single mounting frame 18 and/or sill 22. The astragal assembly 26 can have a uniform width so that it will fit with conventional door sizes and locking mechanisms while remaining useful with a universal mounting system.

Additionally, as the astragal assembly 26 is designed to fit various installations without the requirement of custom sizes or components, manufacturing costs can be reduced and inventory can be decreased.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A door assembly, comprising:

a passive door having an outer edge;

an active door having an outer edge, wherein the active door is mounted for movement between an open position and a closed position in which the outer edge of the active door is aligned with the outer edge of the passive door; and an astragal, wherein the astragal comprises a metallic frame having an exterior portion, an interior portion spaced from and opposed to the exterior portion, a side portion that extends between the exterior portion and the interior portion, and a spacer extending from the side portion towards the passive door to form a gap between the passive door and the side portion, wherein an elongated open channel facing the active door is defined by the exterior portion, the interior portion, and the side portion, and a wooden insert is retained within and substantially fills an area defined by the elongated open channel so that the wooden insert faces the active door, and further comprising a fastener extending through the wooden insert and the side portion into the outer edge of the passive door.

2. The door assembly of claim 1, wherein the astragal includes an interior flange extending from the interior portion and an exterior flange extending from the exterior portion.

3. The door assembly of claim 1, wherein the exterior portion comprises a hollow tubular section having an inner wall and an outer wall.

4. The door assembly of claim 1, wherein the side portion includes a thermal break.

5. The door assembly of claim 1, further comprising door hardware coupled to the wooden insert.

6. The door assembly of claim 5, wherein the hardware includes a strike plate.

7. The door assembly of claim 1, wherein the wooden insert has a U-shaped cross section.

8. The door assembly of claim 1, further comprising a gasket coupled to the exterior portion of the astragal that abuts the active door in the closed position.

* * * * *